US006478675B1

(12) United States Patent
Awada

(10) Patent No.: US 6,478,675 B1
(45) Date of Patent: Nov. 12, 2002

(54) VIDEO POKER GAME

(76) Inventor: Yehia Awada, 3982 Roundwood St., Las Vegas, NV (US) 89107

( * ) Notice: Subject to any disclaimer, the term of this patent is extended or adjusted under 35 U.S.C. 154(b) by 0 days.

(21) Appl. No.: 09/373,591

(22) Filed: Aug. 13, 1999

Related U.S. Application Data

(63) Continuation-in-part of application No. 09/056,805, filed on Apr. 8, 1998, now abandoned.

(51) Int. Cl.[7] ..... A63F 9/24
(52) U.S. Cl. ..... 463/13; 273/292
(58) Field of Search ..... 463/1, 11–13, 463/16, 25, 26, 29, 30, 40, 42; 273/292–293, 309; 700/91–93

(56) References Cited

U.S. PATENT DOCUMENTS 4,743,022 A * 5/1988 Wood ..... 273/292
5,042,818 A * 8/1991 Weingardt et al. ..... 463/13
5,100,137 A * 3/1992 Fulton ..... 463/13
5,511,781 A * 4/1996 Wood et al. ..... 463/13
5,630,753 A * 5/1997 Fuchs ..... 463/13

* cited by examiner

*Primary Examiner*—Mark Sager
(74) *Attorney, Agent, or Firm*—Leonard Weiss

(57) ABSTRACT

In a first phase of a video poker game, a video poker machine displays an image that includes four cards, face up, of a standard deck of cards. A payout is disgorged by the machine in response to the four cards being a predetermined combination. In a second phase of the game, a player may cause an exchange of any of the four cards for a randomly selected card from the deck. Concurrently with the exchange, an image of a fifth card is displayed face up, thereby providing a video display of a five card poker hand. The machine disgorges a payout related to the rank of the poker hand.

14 Claims, 3 Drawing Sheets

VIDEO POKER GAME

This application is a continuation-in-part of an application having Ser. No. 09/056,805 filed on Apr. 8, 1998, now abandoned.

BACKGROUND OF THE INVENTION

1. Field of Invention

This invention is in the general field of casino gaming and, more particularly, relates to playing a poker game on a video poker machine.

2. Description of the Prior Art

Poker is the most frequently played card game in the United States. Moreover, poker has a gambling aspect whereby a player is permitted to wager that he holds a poker hand that is superior to poker hands held by all other players in the game. Without the gambling aspect, poker would be one of the least frequently played card games.

What is arguably the earliest form of poker was played with a deck of twenty cards during the 1830's on Mississippi river boats. Currently, there are approximately 100 variations of poker, most of which are played with a conventional deck of 52 cards. Typically, the number of players in a poker game is from two to eight.

An invariant feature of almost all Poker games is that a poker hand is comprised of five cards. The value of the hand is determined by its rank. The player with the highest ranking hand is usually the winner. The rankings of poker hands, in descending order, are given as:

ROYAL FLUSH, (Ace, King, Queen, Jack and 10 of the same suit);

STRAIGHT FLUSH, (five cards in sequence in any suit, i.e. Jack, 10, 9, 8, 7, of the same suit);

FOUR OF A KIND, (four Aces is highest);

FULL HOUSE, (THREE OF A KIND plus a PAIR, i. e., 10, 10, 10, King King);

FLUSH (Five cards of the same suit);

STRAIGHT (five cards in sequence but of different suits, i.e., (Jack, 10, 9, 8, 7);

THREE OF A KIND (Three cards of the same rank, i.e., three Aces);

TWO PAIRS (i.e., two Kings and two 10's);

ONE PAIR (two 5's); and

NO PAIR

A form of poker, known as video poker, is frequently played in a casino on a video poker machine. When video poker is played, there is no need for a dealer, a table, cheques, cards and a plethora of other items that are used in playing traditional poker. Therefore, video poker utilizes little of the casino's infrastructure. Because little of the casino's infrastructure is used, video poker is favored by the casino. It should be understood that at any given time only one player plays a given video poker machine.

The video poker machine typically includes a video display apparatus that is mounted within a console that has a coin slot and a control panel. At the start of the video poker game, a player deposits one or more coins into the coin slot.

When the coins are deposited, the player depresses a draw/deal pushbutton. In response to the depression of the draw/deal pushbutton, the apparatus provides a video display of five cards of an initial poker hand that are randomly selected from a standard deck of fifty two cards.

The player has an option of causing the apparatus to provide a video representation of an exchange of either any or none of the five cards for a randomly selected card from the deck, thereby forming a video image of a final poker hand. The machine makes a payout based upon the rank of the final poker hand.

SUMMARY OF THE INVENTION

An object of the present invention is to provide a video poker game that captures the interest of a gaming patron.

According to the present invention, in response to money being deposited into a gaming machine, the machine provides a video image of each of four cards, displayed face up, that are randomly selected from a standard deck of fifty two cards. A payout is disgorged by the machine when the four cards are a predetermined combination. The player has an option of causing the machine to provide a video representation of an exchange of either any or none of the four cards for a randomly selected card from the deck. The machine provides an image of a randomly selected fifth card whereby the machine provides a video display of a five card poker hand. The machine disgorges a payout that is related to the rank of the poker hand.

A player may receive a payout that is based upon a combination of images of four cards that are initially provided on a viewing surface of a video poker machine. Additionally, the player may receive a payout based upon an image of a poker hand obtained by a video representation of an exchange of either any or none of the four cards in addition to a video image of a randomly selected fifth card. Accordingly, the player may receive two payouts associated with two phases, respectively, of a video poker game.

Other objects, features, and advantages of the invention should be apparent from the following description of a prferred embodiment thereof as illustrated in the accompanying drawing.

DESCRIPTION OF THE PREFERRED EMBODIMENT

Figure 1:
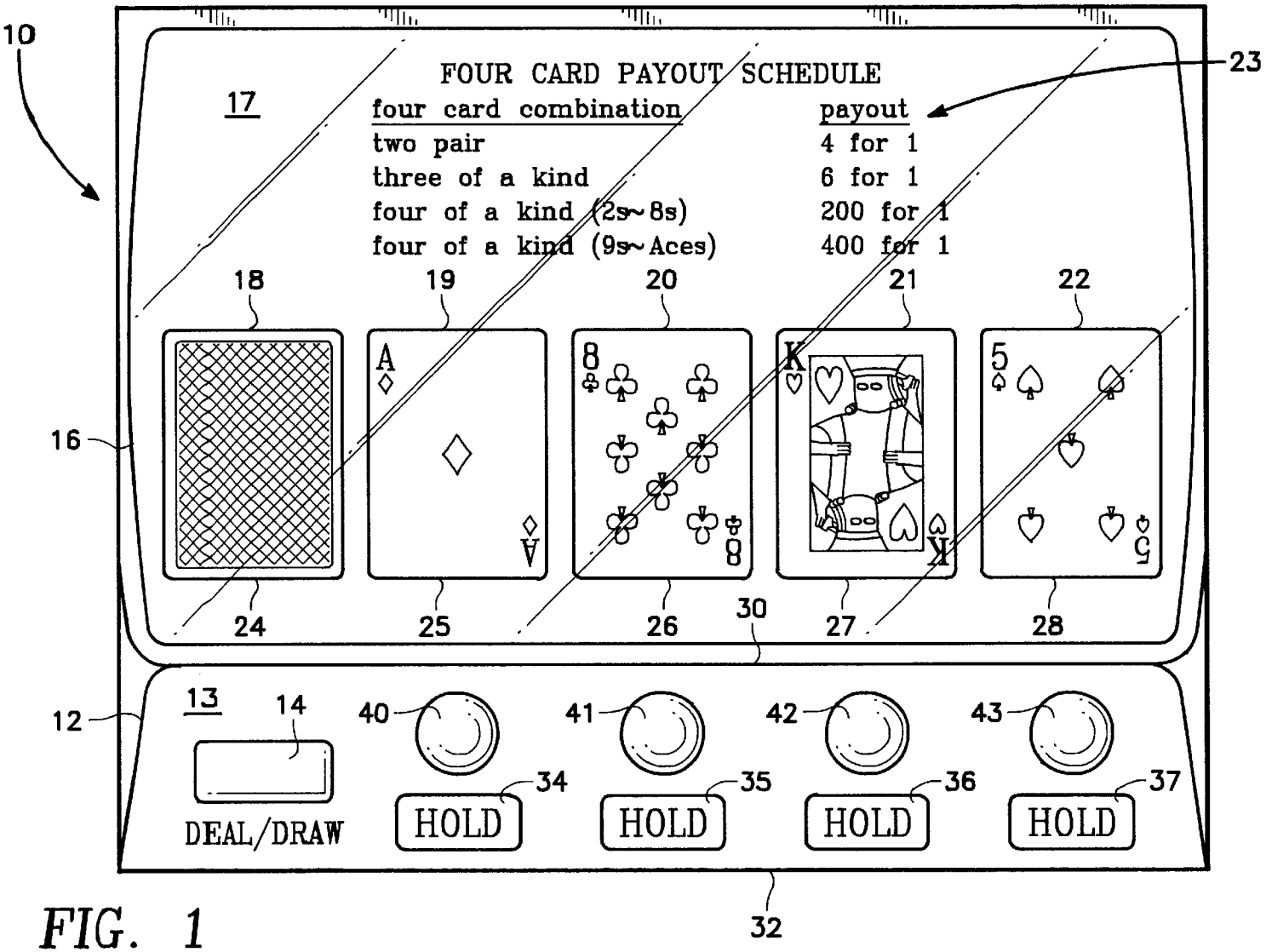
FIG. 1 is a simplified front view of a video poker machine where a video display includes an image of four cards face up and one card face down.

As shown in FIG. 1, a video poker machine 10 includes a coin slot (not shown) wherein a player deposits money in the form of one or more coins. The machine 10 additionally includes a rectangular control panel 12. Extending from a front surface 13 of the panel 12 are a draw/deal switch 14 and a five card payout switch 15.

A video unit 16 is fixedly connected to the panel 12. The unit 16 has a viewing surface 17 that is substantially in a coplanar relationship with the surface 13. The unit 16 has stored therein a video signal representation of each card of a standard deck of playing cards.

After depositing the coins, a first phase of a game is initiated by a momentary depression of the switch 14. In response to the initiation of the first phase, the unit 16 provides on a surface 17 thereof a video image that includes randomly selected cards 18–22 with the card 18 shown face down and the cards 19–22 shown face up.

The cards 18–22 have short side edges 24–28, respectively. Additionally, the cards 18–22 are evenly spaced with the edges 24–28 colinearly aligned parallel to edges 30, 32 of the panel 12.

The image additionally includes a four card payout schedule 23 that lists payouts for predetermined four card combinations of the cards 19–22.

The machine 10 compares signal representations of the cards 19–22 to signal representations of combinations of four cards that are two pair, three of a kind and four of a kind. The machine 10 disgorges a four card payout in accordance with the schedule 23 in response to the cards 19–22 being one of the combinations of four cards.

The cards 19–22 are an Ace, an 8, a King and a 5, respectively. Therefore, the cards 19–22 do not comprise a combination of four cards that causes the machine 10 to disgorge a payout.

The surface 13 has extending therefrom similar pushbutton switches 33–37 that are aligned with centers of the cards 19–22, respectively. Additionally, a hold indicator lamp 39 extends from the surface 13 between the switch 33 and the edge 30. The switches 33–37 have lettering of the word, HOLD, thereon.

The switch 33 is a toggle switch that is depressed to cause the lamp 39 to be illuminated when it is darkened and vice versa.

Indicator lamps 40–43, similar to the lamp 39, extend from the surface 13. The lamps 40–43 have spatial and functional relationships to the switches 34–37, respectively, similar to that described in connection with the lamp 39 and the switch 33.

In a second phase of the game, the player may cause a video representation of an exchange of any of the cards 19–22 for a randomly selected card from the deck. When, for example, the player desires an exchange of the cards 20–22, the switch 34 is depressed, if necessary, to cause an illumination of the lamp 40.

The switches 35–37 are depressed, if necessary, to cause the lamps 41–43, respectively, to be darkened. Thereafter, a momentary depression of the switch 14 causes the exchange and concurrently causes the card 18 to be shown face up.

Figure 2:
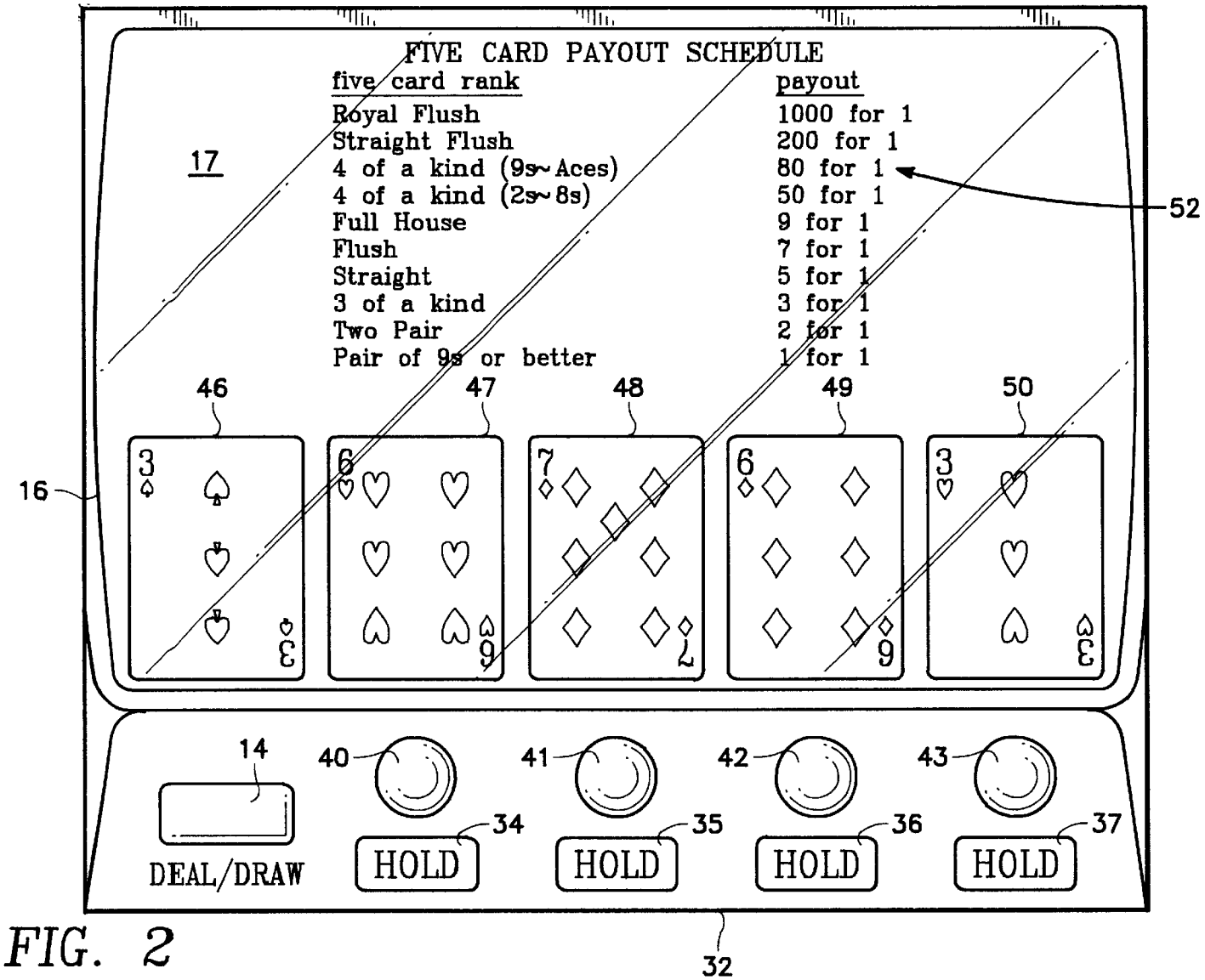
FIG. 2 is the simplified front view of the video poker machine of FIG. 1 where a video display includes an image of five cards face up.

As shown in FIG. 2, when the switches 34–37 are depressed to cause the lamps 40–43 to be darkened, the depression of the switch 14 causes cards 46–50 to be shown face up on the surface 17. The cards 46–50 are randomly selected from the standard deck; they comprise a five card poker hand.

More particularly, the cards 46–50 are shown at locations where the cards 18–22, respectively, were shown in the first phase. The cards 46–50 are the 3 of spades, the 6 of hearts, the 7 of diamonds, the 6 of diamonds and the 3 of hearts, respectively. Therefore, the five card poker hand has the rank of two pair because it includes a pair of 6s (cards 47, 49) and a pair of 3s (cards 46, 50).

Concurrently with the showing of the cards 46–50, a five card payout schedule 52 is shown on the surface 17. The machine 10 compares signal representations of the cards 46–50 to signal representations of combinations of five cards that are a royal flush, a straight flush, four of a kind, a full house, a flush, a straight, three of a kind, two pair and one pair. The machine 10 disgorges a five card payout in accordance with the schedule 52 in response to a momentary depression of the switch 15. When payouts are made in accordance with the schedules 23, 52, players receive, on average, a 97.950858% return of money deposited into the machine 10.

Preferably, the player can purchase either a first option of exchanging one of the cards 46–50 for a randomly selected card from the standard deck or a second option of exchanging two of the cards 46–50 for two randomly selected cards from the standard deck. Hence, an exercise of either the first or the second option causes a formation of a five card augmented poker hand where either one or two of the cards 46–50 have been exchanged. The options can only be purchased when there has not been a five card payout.

The player purchases the first option by depositing an option premium of one additional coin into the machine 10. The player purchases the second option by depositing an option premium of two additional coins into the machine 10.

When, for example, the player desires an exchange of the card 48, one coin is deposited into the machine 10 and the switches 33, 34, 36, 37 are depressed, if necessary, to cause the lamps 39, 42, 43 to be illuminated. The switch 35 is depressed, if necessary, to cause the lamp 41 to be darkened. Thereafter, a momentary depression of the switch 14 causes the desired exchange.

When, for example, the player desires an exchange of the cards 46, 47, two coins are deposited into the machine 10 and the switches 35, 36, 37 are depressed, if necessary, to cause the lamps 41, 42, 43 to be illuminated. The switches 33, 34 are depressed, if necessary, to cause the lamps 39, 40 to be darkened. Thereafter, a momentary depression of the switch 14 causes the desired exchange. When the exchange in accordance with either the first or second options causes the augmented poker hand to have a sufficiently high rank, the machine 10 disgorges a five card payout in accordance with the schedule 52.

Figure 3:
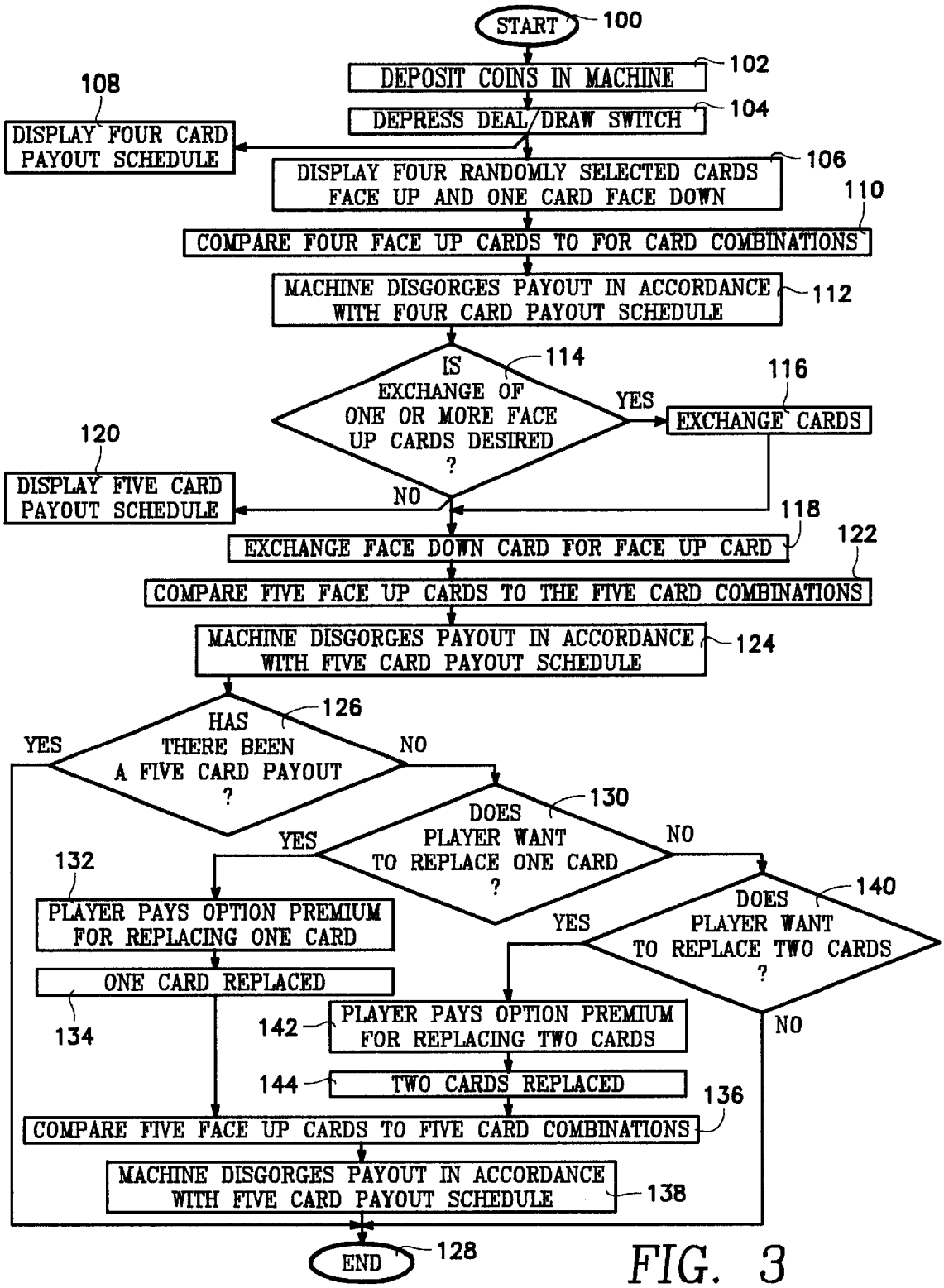
FIG. 3 is a flow chart of the preferred embodiment of the invention.

As shown in FIG. 3, in a flow chart representation of aspects of the present invention, after a start 100, the player deposits money into a video poker machine in accordance with an action element 102. Thereafter, in accordance with an action element 104, the player depresses a draw/deal switch.

In response to depression of the draw/deal switch, there is a video display of four cards face up and one card face down represented by an action element 106. Concurrently, there is a video display of a four card payout schedule represented by an action element 108.

The four face up cards are compared with combinations of four cards to determine whether the four face up cards are a winning combination. The comparison is represented by an action element 110. In response to the four face up cards being a winning combination, the machine disgorges a payout in accordance with an action element 112.

The player decides whether an exchange of any of the four face up cards is desired in a player's decision represented by a decision element 114. An action element 116 is representative of an execution of a decision to make an exchange of any of the four face up cards. Hence, the elements 114, 116 are representative of a card exchange decision and an execution of the card change decision.

After the card exchange decision and its execution, the card that was face down is shown face up in accordance with an action element 118, thereby providing a fifth face up card. Additionally, a five card payout schedule is displayed in accordance an action element 120.

The five face up cards are compared with combinations of five cards to determine whether the five face up cards are a winning combination. The comparison is represented by an action element 122. In response to the five face up cards being a winning combination, the machine disgorges a five card payout in accordance with an action element 124.

When there is a five card payout, the game ends in accordance with a decision element 126 and an action element 128. In further accord with the element 126, when there has not been a five card payout, the player has an option of replacing one card in accordance with a decision element 130.

When the player accepts the one card replacement option, an option premium is paid in accordance with an action element 132. The one card is replaced in accordance with an action element 134. Thereafter, the five face up cards are compared to five card combinations in accordance with an action element 136. In response to the five face up cards being a winning combination the machine disgorges a payout in accordance with the action element 138 and the game ends in accordance with the action element 128.

When the player does not accept the one card replacement option, the player has an option of replacing two cards in accordance with a decision element 140. When the player accepts the two card replacement option, an option premium is paid in accordance with an action element 142. Two cards are replaced in accordance with an action element 134. Thereafter, the five face up cards are compared to five card combinations in accordance with the action element 136. In response to the five face up cards being a winning combination the machine disgorges a payout in accordance with the action element 138 and the game ends in accordance with the action element 128.

While the invention has been particularly shown and described with reference to embodiments thereof, it should be understood by those skilled in the art that changes in form and detail may be made therein without departing from the spirit and scope of the invention.

I claim:

1. The method of a player playing a game on a video poker machine that has a surface whereon a video image is displayed, said machine having stored therein a video signal representation of each card of a standard deck of cards, comprising the steps of:

depositing money into said machine;

providing on said surface a video image that includes an initial four cards face up and one card face down, after said money is deposited;

disgorging from said machine a four card payout in response to said initial four face up cards being a predetermined combination of cards;

permitting said player to cause a video representation of an exchange of only any of only said initial four face up cards for a randomly selected card from said deck, thereby providing an image of a final four face up cards;

providing on said surface a video representation of showing said face down card as a fifth face up card, thereby providing an image of a five card poker hand that includes said final four face up cards and said fifth face up card; and disgorging from said machine a five card payout that is related to the rank of said poker hand.

2. A video poker machine for playing a game in accordance with the method of claim 1.

3. The method of claim 2 wherein said machine has a draw/deal switch, comprising the additional step of operating said switch to cause the exchange of said cards.

4. A video poker machine for playing a game in accordance with the method of claim 3.

5. The method of claim 1 wherein said four card payout is disgorged in accordance with a schedule which is given as:

| four card combination | payout |
|---|---|
| two pair | 4 for 1 |
| 3 of a kind | 6 for 1 |
| 4 of a kind (2s~8s) | 200 for 1 |
| 4 of a kind (9s~Aces) | 400 for 1. |

6. A video poker machine for playing a game in accordance the method of claim 5.

7. The method of claim 1 wherein said five card payout is disgorged in accordance with a schedule which is given as:

| five card rank | payout |
|---|---|
| Royal Flush | 1000 for 1 |
| Straight Flush | 200 for 1 |
| 4 of a kind (9s~Aces) | 80 for 1 |
| 4 of a kind (2s~8s) | 50 for 1 |
| Full House | 9 for 1 |
| Flush | 7 for 1 |
| Straight | 5 for 1 |
| 3 of a kind | 3 for 1 |
| Two pair | 2 for 1 |
| Pair of 9s or better | 1 for 1. |

8. A video poker machine for playing a game in accordance with the method of claim 7.

9. The method of claim 1 comprising the additional step of giving said player an option of exchanging a card of said poker hand for a randomly selected card from the deck, thereby forming an augmented poker hand.

10. A video poker machine for playing a game in accordance with the method of claim 9.

11. In the method of claim 9 wherein said option is given in response to a monetary option premium being deposited into said machine.

12. A video poker machine for playing a game in accordance with the method of claim 11.

13. The method of claim 9 comprising the additional step of disgorging a payout from said machine when said augmented poker hand is in accordance with a payout schedule which is given as:

| augmented poker hand | payout |
|---|---|
| Royal Flush | 1000 for 1 |
| Straight Flush | 200 for 1 |
| 4 of a kind (9s~Aces) | 80 for 1 |
| 4 of a kind (2s~8s) | 50 for 1 |
| Full House | 9 for 1 |
| Flush | 7 for 1 |
| Straight | 5 for 1 |
| 3 of a kind | 3 for 1 |
| Two pair | 2 for 1 |
| Pair of 9s or better | 1 for 1. |

14. A video poker machine for playing a game in accordance with the method of claim 13.

* * * * *